United States Patent [19]

Couch

[11] Patent Number: 4,619,324

[45] Date of Patent: Oct. 28, 1986

[54] WELLHEAD CONNECTOR LOCKING MECHANISM

[75] Inventor: Donald G. Couch, Ventura, Calif.

[73] Assignee: Hughes Tool Company, Houston, Tex.

[21] Appl. No.: 787,203

[22] Filed: Oct. 15, 1985

[51] Int. Cl.[4] ..... E21B 23/00; F16L 55/00

[52] U.S. Cl. ..... 166/344; 166/340; 285/18

[58] Field of Search ..... 166/344, 338–340, 166/342, 368, 377, 378; 285/18

[56] References Cited

U.S. PATENT DOCUMENTS

| | | | |
|---|---|---|---|
| Re. 31,645 | 8/1984 | Regan | 166/340 |
| 3,321,217 | 5/1967 | Ahlstone | 285/18 |
| 3,325,190 | 6/1967 | Eckert et al. | 285/18 |
| 3,675,713 | 7/1972 | Watkins | 166/340 |
| 3,695,633 | 10/1972 | Hanes | 285/18 |
| 3,820,600 | 6/1974 | Baugh | 166/338 |
| 4,109,712 | 8/1978 | Regan | 166/340 |
| 4,364,433 | 12/1982 | Fisher et al. | 166/339 |
| 4,405,016 | 9/1983 | Best | 166/344 X |
| 4,453,745 | 6/1984 | Nelson | 285/18 |

*Primary Examiner*—James A. Leppink
*Assistant Examiner*—Thuy M. Bui
*Attorney, Agent, or Firm*—James E. Bradley

[57] ABSTRACT

A wellhead connector assembly allows connection of a wellhead connector to a subsea wellhead without requiring hydraulic components to remain with the wellhead connector. The connector has latch dogs which are urged by an actuator ring into engagement with the wellhead body. Rods extend upwardly from the actuator ring. A running tool has hydraulic cylinders, each having a shaft for one of the rods. A latching device on each of the shafts latches the hydraulic cylinder shafts to the rods to move the rods up and down. The wellhead connector has a hold-down device which allows the hydraulic cylinders to move the rods downwardly, but prevents them from being moved upwardly. There is a release mechanism which can be used to release the hold-down device to allow the rods to be moved upwardly.

8 Claims, 4 Drawing Figures

WELLHEAD CONNECTOR LOCKING MECHANISM

BACKGROUND OF THE INVENTION

1. Field of the Invention

This invention relates in general to subsea wellhead installations, and in particular to a locking mechanism for locking a wellhead connector to a wellhead.

2. Description of the Prior Art

A typical subsea well has a wellhead body which is supported by a template on the sea floor. The wellhead body is a tubular member having grooves on its exterior surface. For a producing well, casing and tubing will be landed in the wellhead body. A wellhead connector is secured to the top of the wellhead body. The wellhead connector has dogs, each of which have grooves, to extend in and engage the grooves on the wellhead body. An actuator ring, when moved down, cams the dogs inwardly. Rods, secured to the actuator ring, extend upwardly. Hydraulic cylinders are located at the tops of the rods for moving the actuator ring up and down. If the wellhead connector is to be removed, hydraulic connections are made with the cylinders to pull the actuator ring up to remove the wellhead connector.

A disadvantage of this system is that the hydraulic cylinders remain with the wellhead connector, and thus may be located for long periods of time on the sea floor. After long periods of time, the seals of the hydraulic cylinders could deteriorate, preventing them from operating when one wishes to remove the wellhead connector.

SUMMARY OF THE INVENTION

In this invention, the tops of the rods, which are connected to the actuator ring, extend upwardly through a plate located on the subsea well assembly. A running tool, such as a workover connector, has hydraulic cylinders carried by it, each of which has a reciprocal shaft. A latch means is located on the shaft for engaging the upright rods. Also, there is a hold-down means carried by the well assembly which allows the rods to be pushed downwardly, to engage the dogs with the wellhead body, but prevents the rods from moving upwardly. This allows the running tool and the hydraulic cylinders to be removed to the surface while the wellhead connector remains in engagement with the wellhead body. The latch means and hold-down means also include a release mechanism for releasing the rods to allow them to be moved upwardly to remove the wellhead connector.

BRIEF DESCRIPTION OF THE DRAWINGS

FIG'S. 1A, 1B and 1C are vertical sectional views of the upper, middle and lower portions, respectively of a wellhead connector locking mechanism constructed in accordance with this invention. The right half of FIG'S. 1A and 1B is shown in a release position, while the left half is shown in a locking position.

DESCRIPTION OF THE PREFERRED EMBODIMENT

Figure 2:
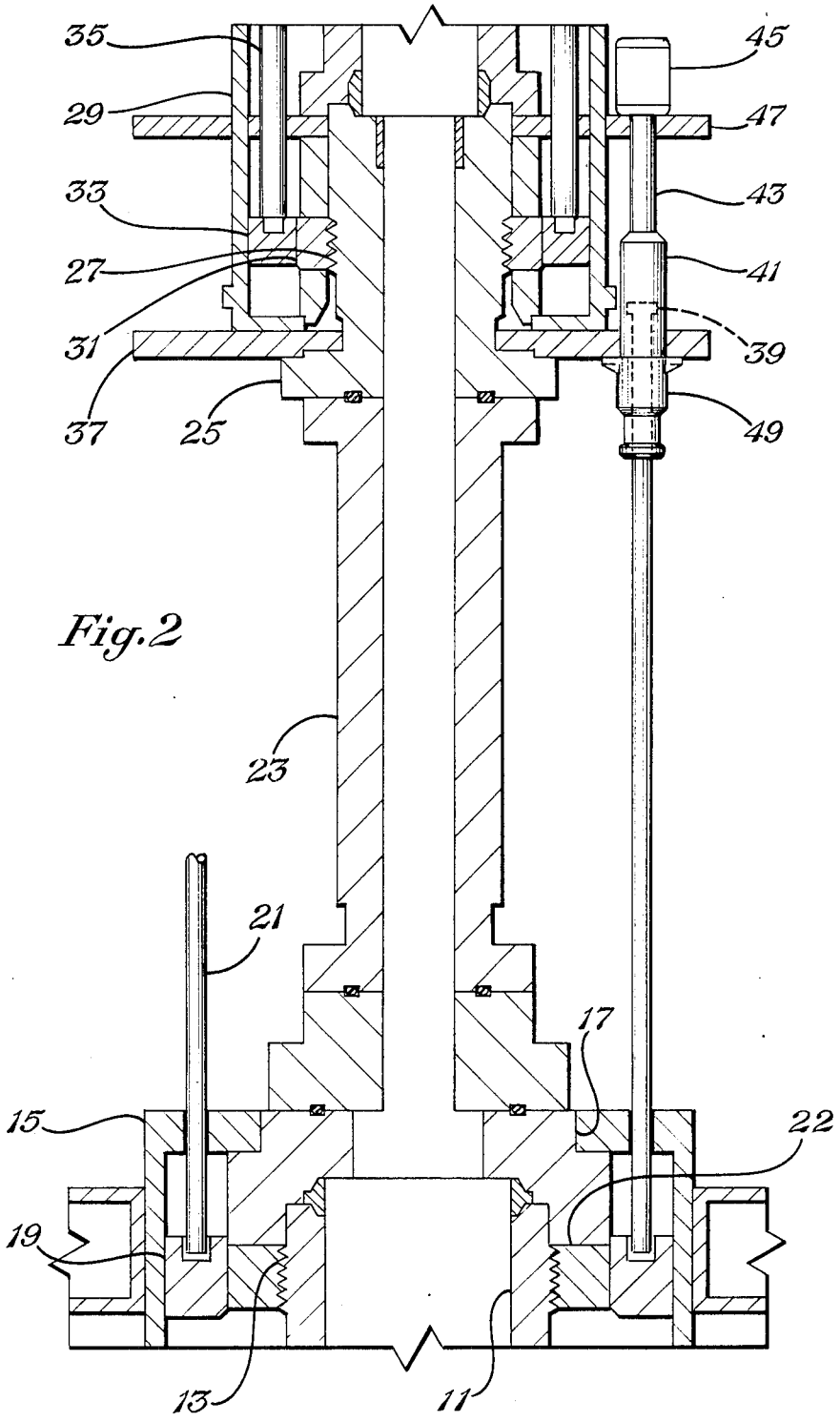
FIG. 2 is a schematic representation of a vertical sectional view of a subsea coupling having a workover connector and a locking mechanism constructed in accordance with this invention.

FIG. 2 has some of the detailed structure omitted for ease in explanation. The main features include a wellhead body 11 which protrudes upwardly from the sea floor (not shown), and has grooves 13 on its exterior. A wellhead connector 15 is adapted to be secured to the wellhead body 11. The wellhead connector 15 has a cap portion 17 that fits over the wellhead body 11. The wellhead connector 15 has an actuator ring 19 that is connected to a plurality of vertical rods 21 that extend upwardly. When the rods 21 are pushed downwardly, they move the actuator ring 19 downwardly to push inward a plurality of dogs 22. The dogs 22 have grooves on the interior surfaces for engaging the grooves 13 to lock the wellhead connector 15 to the wellhead body 11.

The coupling for the wellhead body 11 also includes a valve block 23 which is mounted to the top of the wellhead connector 15, and a tree mandrel 25 mounted on top of valve block 23. The valve block 23 has ports (not shown) for connecting various valves. Tree mandrel 25, similar to the wellhead body 11, has grooves 27 on its exterior. The grooves allow other connectors to be lowered from the surface and secured to the coupling. In the embodiment in FIG. 2, a workover connector 29 is shown secured to the tree mandrel 25. The workover connector 29 may be connected to a string of riser (not shown) extending to a workover vessel at the surface. The workover connector 29 has a plurality of dogs 31 which are moved inwardly by an actuator ring 33 to engage the grooves 27. Upward movement of the actuator ring 33 releases the dogs 31 for allowing the workover connector 29 to be withdrawn. The actuator ring 33 is moved upwardly and downwardly by a hydraulic cylinder shaft 35 that is connected to a hydraulic cylinder (not shown) mounted to the workover connector 29.

An annular plate 37 will be mounted to the tree mandrel 25, and is located below the workover connector 29 when the workover connector 29 is installed on the tree mandrel 25. The rods 21 extending upwardly from the wellhead connector 15 extend through holes in the plate 37. The tops of rods 21 protrude a few inches above, each top having a recess or groove 39.

The workover connector 29 has a latch means 41 for engaging the groove 39 of each rod 21. The latch means 41 is secured to a shaft 43, which is an engaging member reciprocated by a hydraulic cylinder 45. The hydraulic cylinder 45 is mounted to a bracket 47 which is part of the workover connector 29. When the latch means 41 engages the rod 21, actuating the hydraulic cylinder 45 will cause the rods 21 to move downwardly to push the actuator ring 19 down, camming in the dogs 22 of the wellhead connector 15. A hold-down means 49 mounted to the plate 37 holds each rod 21 in the lower position, with the wellhead connector 15 locked to the wellhead body 11. The hold-down means 49 also has a release means (not shown in FIG. 2) which will release the rods 21, allowing the hydraulic cylinders 45 to draw the rods 21 upwardly to remove the wellhead connector 15 from the wellhead body 11.

Briefly summarizing the operation, the entire assembly, including the wellhead connector 15, valve body 23, tree mandrel 25 and workover connector 29 can be lowered into place over the wellhead body 11, with the workover connector 29 serving as a running tool. The hydraulic cylinders 45 can then be actuated to push the rods 21 down to secure the wellhead connector 15 to the wellhead body 11. Subsequently, with the hold-down means 49 holding the rods 21 downwardly, the hydraulic cylinders (not shown) of the workover connector 29 can be actuated to release the dogs 31, allowing the workover connector 29 to be pulled to the surface, carrying along with it the hydraulic cylinders 45 and the latch means 41. This leaves only the plate 37 and the tree mandrel 25 in place, with the rods 21 protruding upward a short distance. A production riser (not shown) can then be secured to the tree mandrel 25 for producing oil or gas.

Figure 1A:
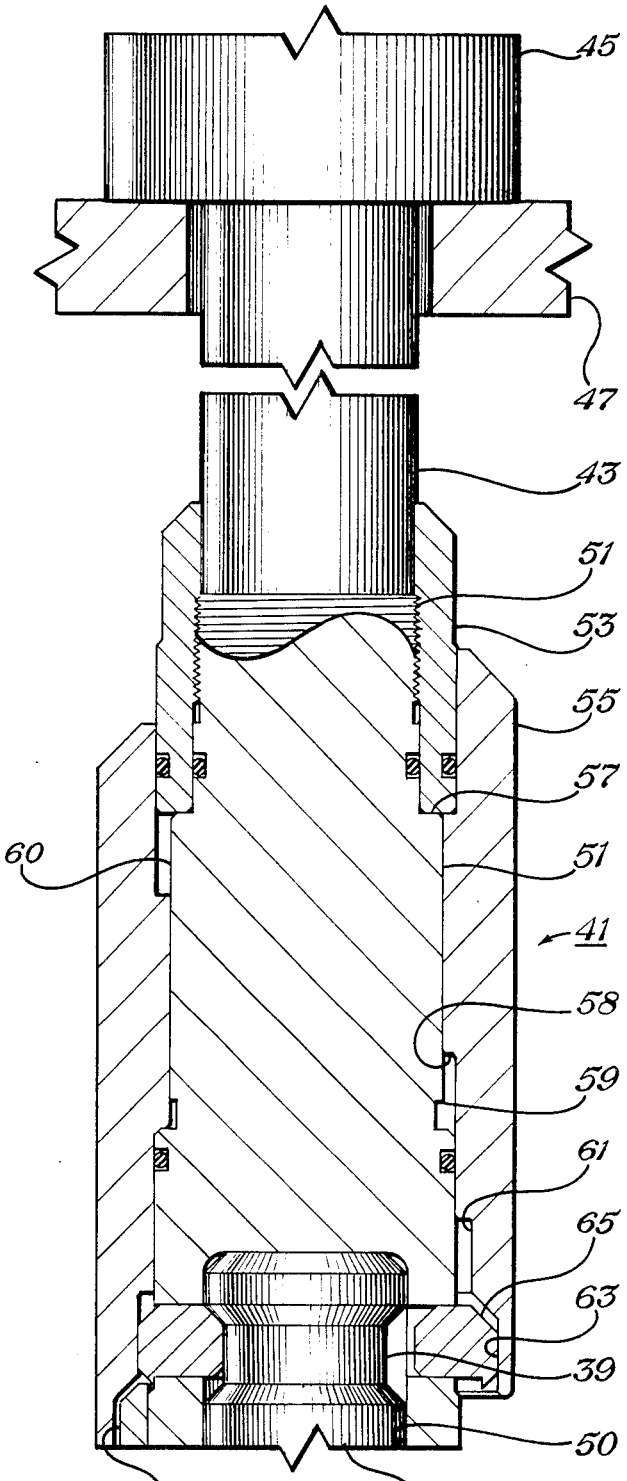

Referring now to FIG. 1A, the latch means 41 is shown in detail. The hydraulic cylinder shaft 43 has a receptacle or cavity 50 extending upwardly into it for receiving the rods 21. The shaft 43 has an exterior threaded section 51 for receiving a tubular retainer 53. Retainer 53 receives below it an upper sleeve 55. Sleeve 55, as shown by comparing the right and left sides of FIG. 1A, moves between a lower engaged position (shown in the left side) and an upper disengaged position. An internal shoulder 57 formed in the bore of the upper sleeve 55 limits the upward travel. A shoulder 58, which faces downwardly, and is formed in the bore of upper sleeve 55, provides the limit for the lower position. A recess or pressure chamber 59 is located below shoulder 58, for moving the sleeve 55 upwardly when supplied with hydraulic fluid through passages (not shown). There is also a pressure chamber 60 located above shoulder 57, which, when supplied when hydraulic fluid, moves the sleeve 55 to the lower position. O-rings, not specifically numbered, are provided for sealing.

On the lower end of sleeve 55, there is an upper counterbore 61 and a lower counterbore 63, which is of larger diameter than the upper counterbore 61. Counterbores 61 and 63 are adapted to slide over dogs 65 carried by shaft 43 and extending into cavity 50. Dogs 65 move between an outer, disengaged position, as shown in the right side of the drawing, and an inner position engaging the groove 39 on the rod 21. The upper sleeve 55 thus latches the shaft 43 to the rod 21 when it is moved to the lower position. When the sleeve 55 is moved to the upper position, the dogs 65 are free to move outwardly, disengaging the latch means 41.

Figure 1B:
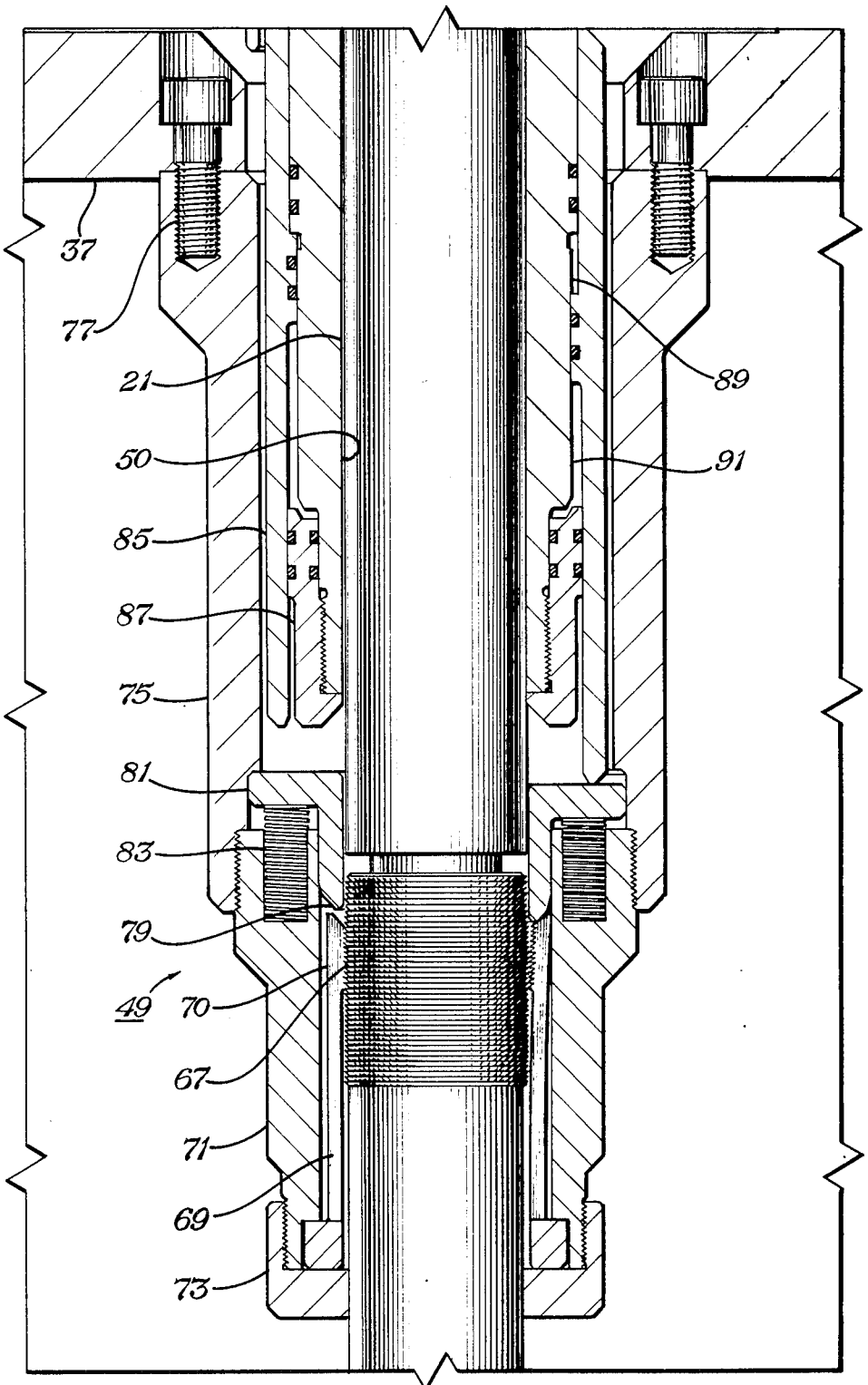

Referring now to FIG. 1B, the hold-down means 49 is shown in more detail. A section of wicker grooves 67 are formed on the rod 21. Wicker grooves 67 are small closely spaced grooves, each inclined upwardly. An annular collet 69 has a plurality of resilient fingers 70 that extend upwardly, and contain grooves on the inner side to mate with the wicker grooves 67. In the normal position, the fingers 70 will be biased inwardly for engaging the grooves 67, as shown on the left side of FIG. 1B. The fingers 70 can be pushed outwardly, as shown in the right side, to disengage the collet 69 from the grooves 67. Collet 69 is retained within a lower housing 71 by a retainer 73 secured to the lower end. Lower housing 71 is secured to an upper housing 75 by threads. The upper housing 75 is secured to bolts 77 to the plate 37 that locates on top of the valve block 23 (FIG. 2). This arrangement allows the rods 21 to be freely pushed downwardly by the shafts 43 (FIG. 1A), with the collet fingers 70 ratcheting over the grooves 67. The collet fingers 70 will not allow any upward movement of the rod 21, however, unless the fingers 70 are pulled to the release position, as shown in FIG. 1B on the right side.

The release means includes an annular cam 79. The cam 79 is a sleeve which has a lower end that is tapered to engage the tapered upper ends of the fingers 70. When the cam 79 is moved to the lower position, as shown in the right side of FIG. 1B, it pushes the fingers 70 radially outward, disengaging them completely from the wicker grooves 67. Cam 79 has an upper flange 81. Flange 81 is biased upwardly by coil springs 83, which are inserted between the flange 81 and the lower housing 71. A lower sleeve 85, which is reciprocally carried on the shaft 43, serves to move the cam 79 up and down. The lower sleeve 85 is secured by a retainer 87 located at the bottom of the shaft 43. A pressure chamber 89 is located between the lower sleeve 85 and the shaft 43 for moving the sleeve 85 downwardly when supplied with hydraulic pressure through passages (not shown). There is also a lower pressure chamber 91 located between the retainer 87 and the lower sleeve 85, which when supplied with pressure through hydraulic passages (not shown), will move the lower sleeve 85 back upwardly. The lower end of the sleeve 85 is adapted to contact the flange 81 to push the cam 79 downwardly, compressing the springs 83.

Figure 1C:
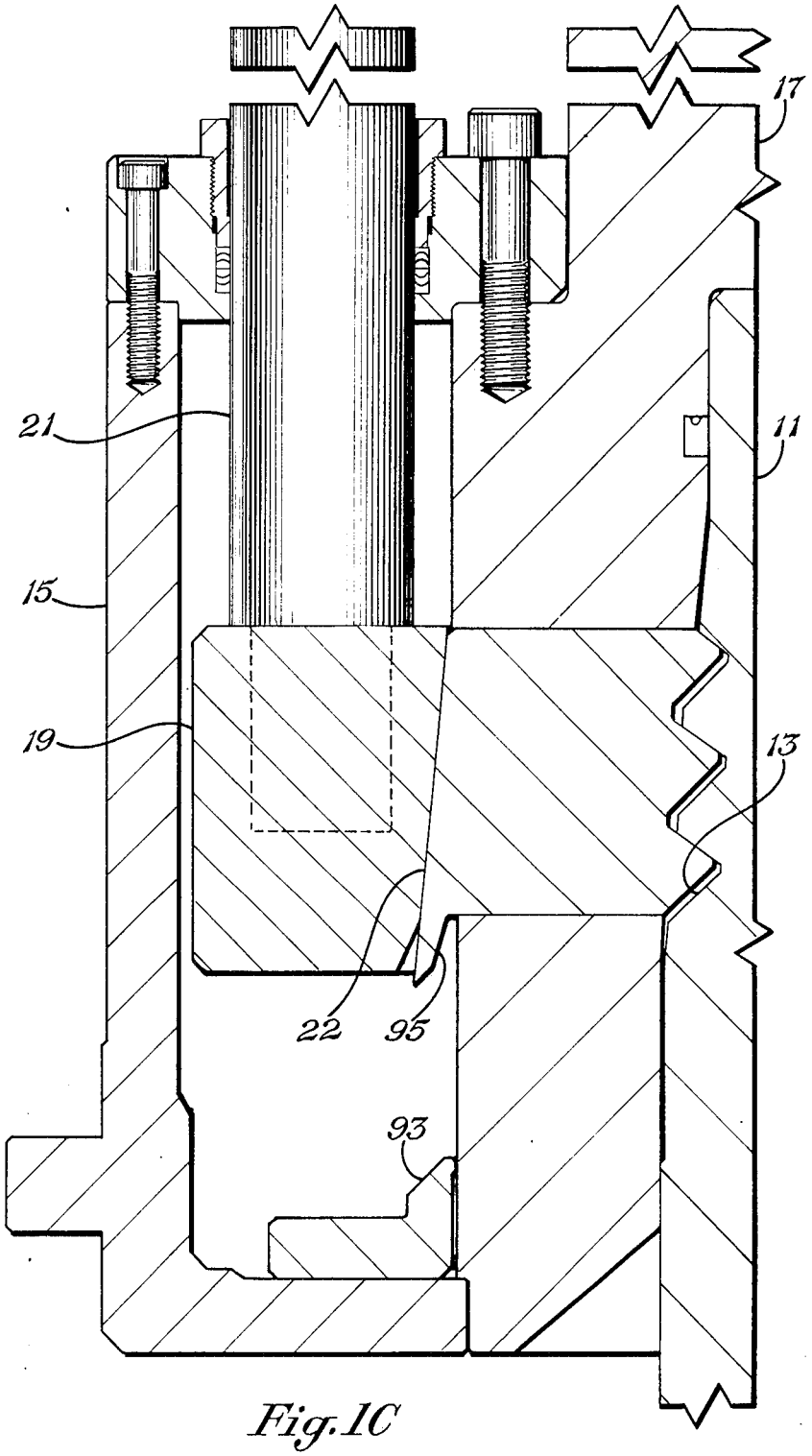

FIG. 1C shows in an enlarged view the actuator ring 19 for camming the dogs 22 into engagement with the grooves 13 on the wellhead body 11. A release cam 93 is carried below the actuator ring 19. The cam 93 engages a depending lip 95 on dogs 22 to pull the dogs 22 from the engaged position when the actuator ring 19 is pulled upwardly. The release cam 93 is secured by linkage rods (not shown) to actuator ring 19 for upward movement with the actuator ring 19.

In operation, referring to FIG. 2, to secure the wellhead connector 15 to a wellhead body 11, a valve block 23 and a tree mandrel 25 will be secured to the wellhead connector 15 at the surface. The workover connector 29 will be secured to the tree mandrel 25 at the surface. The latch means 41 will be secured to the upper ends of the rods 21. The actuator ring 19 will be in an upper position, and the dogs 22 will be retracted. Then the entire assembly is lowered down over the wellhead body 11. The hydraulic cylinders 45 are actuated to move the rods 21 downwardly, pushing the dogs 22 into engagement with the wellhead body 11. Referring to FIG. 1B, collet fingers 70 will ratchet over wicker grooves 67 during the downward movement of rods 21. Fingers 70 will prevent upward movement of rods 21 relative to lower housing 71. This secures the workover connector 29 and wellhead connector 15 to wellhead body 11.

To release the workover connector 29 for removal to the surface, as shown in FIG. 1A, hydraulic fluid is supplied to the chamber 59, moving the sleeve 55 upwardly. When the shaft 43 is retracted by the hydraulic cylinder 45, this allows the dogs 65 to move outwardly. Referring to FIG. 2, the shaft 35 is retracted, allowing the dogs 31 to move outwardly. The workover connector 29 is then pulled upwardly, bringing along with it shafts 43, and as shown in FIG. 1B, the lower sleeves 85 and retainer 87. The coupling comprising wellhead connector 15, valve block 23, and tree mandrel 25 remain in place on the wellhead body 11.

If it is later desired to remove the wellhead connector 15 from wellhead body 11, the workover connector 29 is lowered down onto the tree mandrel 25 and connected as previously described. The shafts 43 will slide over the upper end of the rods 21, as shown in FIG. 1A. Hydraulic fluid supplied to chamber 60 moves upper sleeve 55 downwardly to push shaft dogs 65 into engagement with recess 39. As shown in FIG. 1B, hydraulic fluid is supplied to chamber 89 to push the lower sleeve 85 downwardly, pushing along with it the cam 79. The cam 79 retracts the collet fingers 70. Then the hydraulic cylinders 45 (FIG. 1A) are actuated to pull the rods 21 upwardly, releasing the dogs 22 (FIG. 2). Then the entire assembly can be pulled upwardly, leaving only the wellhead body 11.

The invention has significant advantages. The connector assembly allows the wellhead connector to be coupled to it without the requirement for any hydraulic components to remain downhole with the subsea assembly. The workover connector can be withdrawn to the surface, bringing along with it any components having elastomer seals or hydraulic components.

While the invention has been shown in only one of its forms, it should be apparent to those skilled in the art that it is not so limited, but is susceptible to various changes without departing from the scope of the invention.

I claim:

1. In a subsea wellhead assembly having an upstanding wellhead body, a coupling adapted to be connected to the wellhead body, a plurality of latch dogs carried by the coupling, and an actuator ring carried by the coupling for movement between a lower position moving the dogs inward into latching engagement with the wellhead body, and an upper position freeing the dogs to move outward out of the latching engagement with the wellhead body, an improved means for moving and securing the actuator ring, comprising in combination:

a plurality of upright rods secured to the actuator ring for movement therewith;

a running tool assembly adapted to be lowered fom the surface and adapted to engage the coupling;

a plurality of engaging members carried by the running tool assembly, each adapted to engage one of the rods;

hydraulic means for moving the engaging members up and down relative to the running tool assembly;

latch means for releasably latching the engaging members to the rods for movement in unison to stroke the actuator ring up and down with the hydraulic means; and hold-down means carried by the coupling for allowing downward movement of the rods relative to the coupling, but selectively preventing upward movement, to secure the actuator ring in the lower position, allowing the running tool assembly to be retrieved with the coupling remaining in place.

2. In a subsea wellhead assembly having an upstanding wellhead body, a coupling adapted to be connected to the wellhead body, a plurality of latch dogs carried by the coupling, and an actuator ring carried by the coupling for movement between a lower position moving the dogs inward into latching engagement with the wellhead body, and an upper position freeing the dogs to move outward out of latching engagement with the wellhead body, an improved means for moving and securing the actuator ring, comprising:

an annular plate carried by the coupling above the actuator ring, having a plurality of holes;

a plurality of upright rods secured to the actuator ring for movement therewith, each aligned with one of the holes;

a running tool assembly adapted to engage the coupling and adapted to be lowered from the surface;

a plurality of shafts carried by the running tool assembly, each adapted to engage one of the rods;

hydraulic means for moving the shafts up and down relative to the running tool assembly;

latch means for releasably latching each of the shafts to the rods for movement therewith to stroke the actuator ring up and down with the hydraulic means;

hold-down means mounted to the plate for each of the rods, for allowing downward movement of each rod relative to the coupling, but selectively preventing upward movement, to secure the actuator ring in the lower position, allowing the running tool assembly to be retrieved with the coupling remaining in place; and release means for releasing the hold-down means to allow each of the rods to be moved upwardly for releasing the coupling from the wellhead body.

3. In a subsea wellhead assembly having an upstanding wellhead body, a coupling adapted to be connected to the wellhead body, a plurality of latch dogs carried by the coupling, and an actuator ring carried by the coupling for movement between a lower position moving the dogs inward into latching engagement with the wellhead body, and an upper position freeing the dogs to move outward out of latching engagement with the wellhead body, an improved means for moving and securing the actuator ring, comprising:

an annular plate carried by the coupling above the actuator ring, having a plurality of holes;

a plurality of upright rods secured to the actuator ring for movement therewith, each aligned with one of the holes, each rod having at least one exterior groove;

a running tool assembly adapted to engage the coupling, and adapted to be lowered from the surface;

a plurality of engaging members carried by the running tool assembly, each adapted to engage one of the rods;

hydraulic means for moving the engaging member up and down relative to the running tool assembly;

latch means for releasably latching the engaging members to the rods;

a plurality of collets carried by the plate, each having at least one inwardly biased finger for engaging the groove in the rod, to prevent upward movement of the rod relative to the plate, allowing the running tool assembly to be retrieved with the coupling remaining in place; and release means carried by the engaging members, for moving the finger out of engagement with the rod groove, allowing the rods to be moved upwardly by the hydraulic means to remove the coupling from the wellhead.

4. In a subsea wellhead assembly having an upstanding wellhead body, a coupling adapted to be connected to the wellhead body, a plurality of latch dogs carried by the coupling, and an actuator ring carried by the coupling for movement between a lower position moving the dogs inward into latching engagement with the wellhead body, and an upper position freeing the dogs to move outward out of latching engagement with the wellhead body, an improved means for moving and securing the actuator ring, comprising:

an annular plate carried by the coupling above the actuator ring, having a plurality of holes;

a plurality of upright rods secured to the actuator ring for movement therewith, each aligned with one of the holes, each rod having a plurality of upwardly inclined grooves;

a running tool assembly adapted to engage the coupling and to be lowered from the surface;

a plurality of engaging members carried by the running tool assembly, each adapted to engage one of the rods;

latch means for releasably latching the engaging member to the rods;

hydraulic means for moving the engaging members up and down relative to the running tool assembly to stroke the actuator ring;

a plurality of collets carried by the plate, each having a plurality of inwardly biased fingers, each having downwardly inclined grooves on its inner surface for engaging the grooves on the rod, the fingers ratcheting over the rod grooves when the rods move downwardly relative to the fingers, but preventing the rods from moving upwardly relative to the fingers, allowing the running tool assembly to be retrieved with the coupling in place;

a cam member reciprocally carried by the plate above the collets;

spring means for urging the cam member upwardly; and actuator means hydraulically actuated and carried by the engaging members, for moving the cam member downwardly to wedge the fingers out of engagement with the rod grooves, allowing the rods to be moved upwardly by the hydraulic means to remove the coupling from the wellhead.

5. In a subsea wellhead assembly having an upstanding wellhead body, a coupling adapted to be connected to the wellhead body, a plurality of latch dogs carried by the coupling, and an actuator ring carried by the coupling for movement between a lower position moving the latch dogs inward into latching engagement with the wellhead body, and an upper position freeing the latch dogs to move outward out of latching engagement with the wellhead body, an improved means for moving and securing the actuator ring, comprising:

a plurality of upright rods secured to the actuator ring for movement therewith;

a running tool assembly adapted to engage the coupling and adapted to be lowered from the surface;

a plurality of shafts carried by the running tool assembly;

each of the shafts having a receptacle for receiving one of the rods;

a sleeve reciprocally carried by each of the shafts;

hydraulic means for moving the sleeve between an upper and lower position relative to the shaft;

a shaft dog mounted to the receptacle;

each of the rods having a recess adjacent its upper end for engagement by the shaft dog;

the shaft dog being movable inwardly by downward movement of the sleeve, causing the shaft dog to engage the recess, thereby latching the shaft to the rod, the sleeve when moved to the upper position, allowing the shaft dog to move outwardly from the recess, disengaging the shaft from the rod; and hold-down means carried by the coupling for allowing downward movement of the rods relative to the coupling, but selectively preventing upward movement, to secure the actuator ring in the lower position, allowing the running tool assembly to be retrieved with the coupling remaining in place.

6. In a subsea wellhead assembly having an upstanding wellhead body, a coupling adapted to be connected to the wellhead body, a plurality of latch dogs carried by the coupling, and an actuator ring carried by the coupling for movement between a lower position moving the latch dogs inward into latching engagement with the wellhead body, and an upper position freeing the latch dogs to move outward out of the latching engagement with the wellhead body, an improved means for moving and securing the actuator ring, comprising in combination:

an annular plate carried by the coupling above the actuator ring, having a plurality of holes;

a plurality of upright rods secured to the actuator ring for movement therewith and aligned with the holes, each of the rods having at least one exterior groove;

a running tool assembly adapted to engage the coupling and adapted to be lowered from the surface;

a plurality of hydraulic cylinders carried by the running tool assembly, each having a reciprocal shaft adapted to engage one of the rods;

each of the shafts having a receptacle for receiving one of the rods;

an upper sleeve reciprocally carried by each of the shafts;

hydraulic means for moving the upper sleeve between an upper and a lower position relative to the shaft;

a plurality of shaft dogs mounted to the receptacle;

each of the rods having a recess adjacent its upper end for engagement by the shaft dogs;

the shaft dogs being movable inwardly by downward movement of the upper sleeve to latch the shaft to the rod, the shaft dogs being movable outwardly when the upper sleeve moves to the upper position, disengaging the shaft from the rod;

a plurality of collets carried by the plate, each having at least one inwardly biased finger for engaging the groove in the rod, to prevent upward movement of the rod relative to the housing, allowing the running tool assembly to be retrieved with the coupling remaining in place;

a cam member reciprocally carried by the plate above the collet;

a lower sleeve carried by the shaft for movement between a lower position relative to the shaft in which it has moved the cam member downwardly to wedge each collet finger out of engagement with each rod groove, and an upper position wherein the cam member allows each collet finger to engage each groove in the rod; and means for moving the lower sleeve between the upper and lower positions.

7. A method of connecting a coupling to a subsea wellhead body, the coupling being of the type having a plurality of latch dogs carried by the coupling and an actuator ring carried by the coupling for movement between a lower position moving the dogs inward into a latching engagement with the wellhead body, and an upper position freeing the dogs to move outward out of latching engagement with the wellhead body, the method comprising in combination:

mounting a plurality of upright rods to the actuator ring for movement therewith;

providing a running tool with a plurality of engaging members, each for engaging one of the rods;

latching the engaging members to the rods;

lowering the running tool and coupling to the wellhead;

moving the rods downwardly to move the actuator ring to the lower position;

retaining the rods in the lower position; and unlatching the engaging members from the rods, and pulling the running tool to the surface, leaving the coupling on the wellhead.

8. A method of connecting a coupling to a subsea wellhead body, the coupling being of the type having a plurality of latch dogs carried by the coupling and an actuator ring carried by the coupling for movement between a lower position moving the dogs inward into a latching engagement with the wellhead body, and an upper position freeing the dogs to move outward out of latching engagement with the wellhead body, the method comprising in combination:

mounting a plurality of upright rods to the actuator ring for movement therewith;

providing a running tool with a plurality of hydraulic cylinders, each having a reciprocal shaft for engaging one of the rods;

locking the rods to the shafts;

lowering the running tool and coupling to the wellhead;

moving the rods downwardly to move the actuator ring to the lower position;

retaining the rods in the lower position;

unlatching the shafts from the rods, and pulling the running tool to the surface, leaving the coupling on the wellhead;

then, to remove the coupling from the subsea wellhead, lowering the running tool over the coupling while the coupling is in place on the wellhead body; then relatching the shafts to the rods; then releasing the rods from the lower position; then moving the shafts upwardly, pulling up the actuator means and allowing the dogs to release the engagement with the wellhead body; then pulling the running tool and coupling to the surface.

* * * * *